US008500352B1

(12) United States Patent
Messersmith et al.

(10) Patent No.: US 8,500,352 B1
(45) Date of Patent: Aug. 6, 2013

(54) AIRTIGHT DEVICE FOR PACKAGING AND APPLYING A SOLID PRODUCT

(75) Inventors: James Edward Messersmith, Port Hueneme, CA (US); David Scott Patrick, Ojai, CA (US)

(73) Assignee: The Spatz Corporation, Oxnard, CA (US)

( * ) Notice: Subject to any disclaimer, the term of this patent is extended or adjusted under 35 U.S.C. 154(b) by 0 days.

(21) Appl. No.: 13/484,734

(22) Filed: May 31, 2012

(51) Int. Cl.
*B43K 21/02* (2006.01)
*A45D 40/04* (2006.01)
*A45D 40/06* (2006.01)

(52) U.S. Cl.
USPC ..... 401/78; 401/49; 401/55; 401/68; 401/172

(58) Field of Classification Search
USPC ..... 401/49, 55, 68, 78, 172
See application file for complete search history.

(56) References Cited

U.S. PATENT DOCUMENTS 3,216,563 A * 11/1965 Finkenzeller ..... 401/76
5,888,004 A * 3/1999 Bouix ..... 401/87
6,629,797 B1 * 10/2003 Lee ..... 401/78
6,835,016 B2 * 12/2004 Noguchi ..... 401/75
7,736,079 B2 * 6/2010 Tani ..... 401/69
8,104,984 B2 * 1/2012 Tani ..... 401/70
2013/0058700 A1 * 3/2013 Liu ..... 401/52

* cited by examiner

*Primary Examiner* — David Walczak
*Assistant Examiner* — Joshua Wiljanen
(74) *Attorney, Agent, or Firm* — Sinorica, LLC

(57) ABSTRACT

The present invention is a mechanically operating device used for packaging and applying a product. A molded product traverses through a barrel as an actuator sleeve is rotated. The actuator sleeve rotates an actuator, propelling a driver through the barrel. The driver is keyed into the barrel using a clutch washer—the clutch washer prevents the rotation of the driver. Mechanical actuating splines on the actuator engage the threads of the driver. The forward motion of the driver transversely pushes a cup out from an orifice of the barrel. The molded product is fitted within the cup. A cap is hermetically sealed to a barrel to create dynamic vapor chamber that prevents any contamination or alteration of the molded product. Primary and secondary seals between the barrel and the cap as well as between the cup and the barrel maintain the airtight feature of the dynamic vapor chamber.

20 Claims, 27 Drawing Sheets

AIRTIGHT DEVICE FOR PACKAGING AND APPLYING A SOLID PRODUCT

FIELD OF THE INVENTION

The present invention relates generally to a device for sequestering a solid product from interactions with the atmosphere. More particularly, the objective is to hermetically seal a molded product within a mechanical device and to be able to dispense the molded product repeatedly without contamination to the molded product while it is not use.

BACKGROUND OF THE INVENTION

Oftentimes, it is desired to use a product that can become altered or contaminated as it is exposed to the atmospheric environment. The underlying formula of the product may have an adverse reaction with the air molecules if exposed for extended durations of time. For example, a highlighter, a marker, or a pen transfers a fluid product to a surface when it is being applied from a tip; however, the transferred fluid product may dry up, harden or lose its effectiveness if the tip remains exposed over time. These devices typically are used repeatedly and are not for one time use. A permanent seal prevents the use of the product altogether. This dilemma can be solved by fitting a cap over exposed portion of the device to create an airtight chamber, further preventing any exposure to the environment. Seals between the cap and the product must be maintained over time as the cap is repeatedly removed and reapplied. If the product needs to be mechanically propelled out of an encasement into the environment, yet also needs to be constantly resealed, then the airtight chamber must be dynamic in order to adapt to the changes. The quality of a device may ultimately depend on its repeated and dynamic sealing capability. The object of the present invention is to provide a mechanical device with the ability to hermetically seal and reseal a solid product that continually is axially propelled out from its encasement.

DETAIL DESCRIPTIONS OF THE INVENTION

All illustrations of the drawings are for the purpose of describing selected versions of the present invention and are not intended to limit the scope of the present invention.

Figure 1:
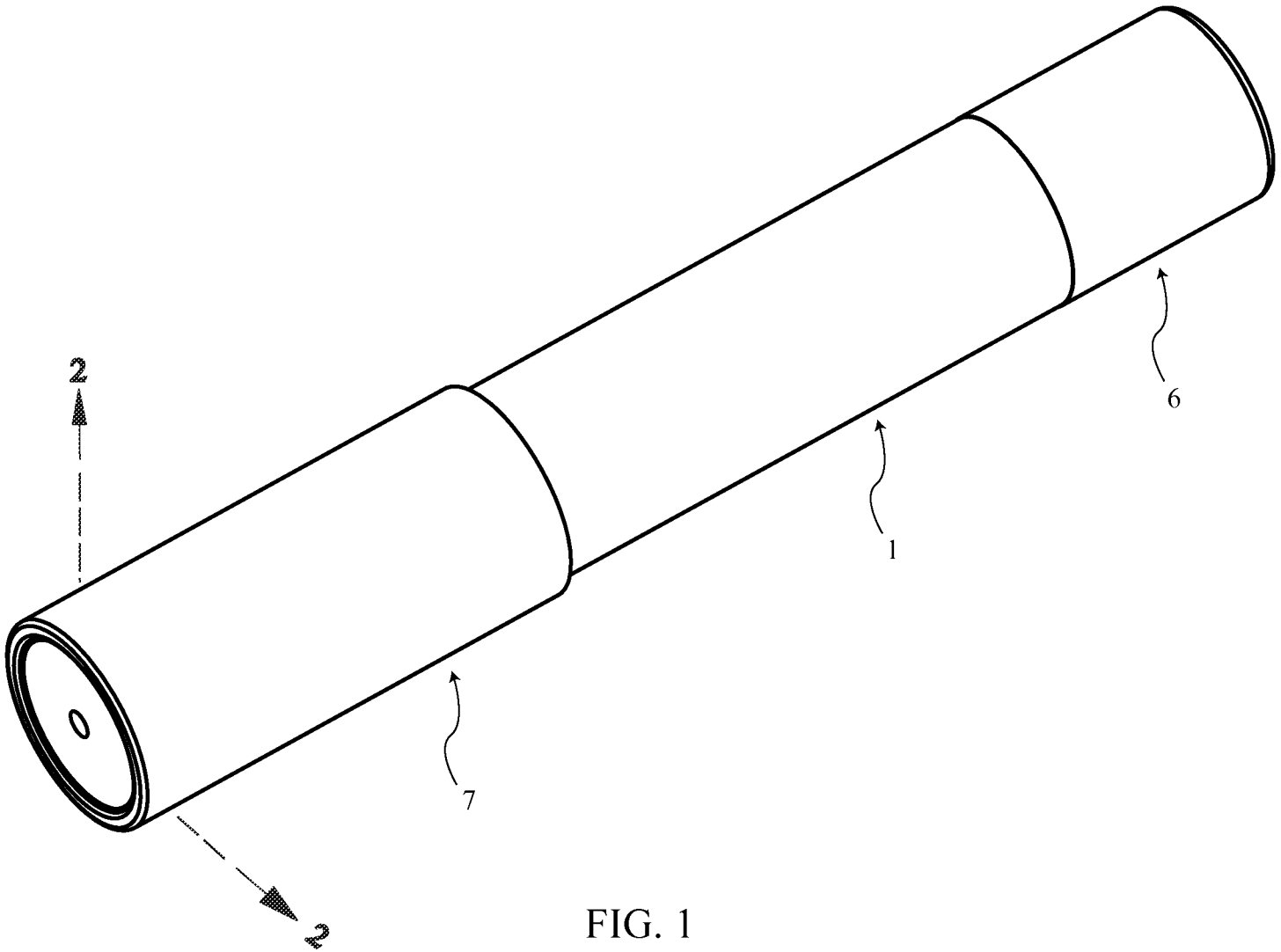
FIG. 1 is a perspective view of the present invention, showing the plane 2-2 which a half section is taken.
Figure 2:
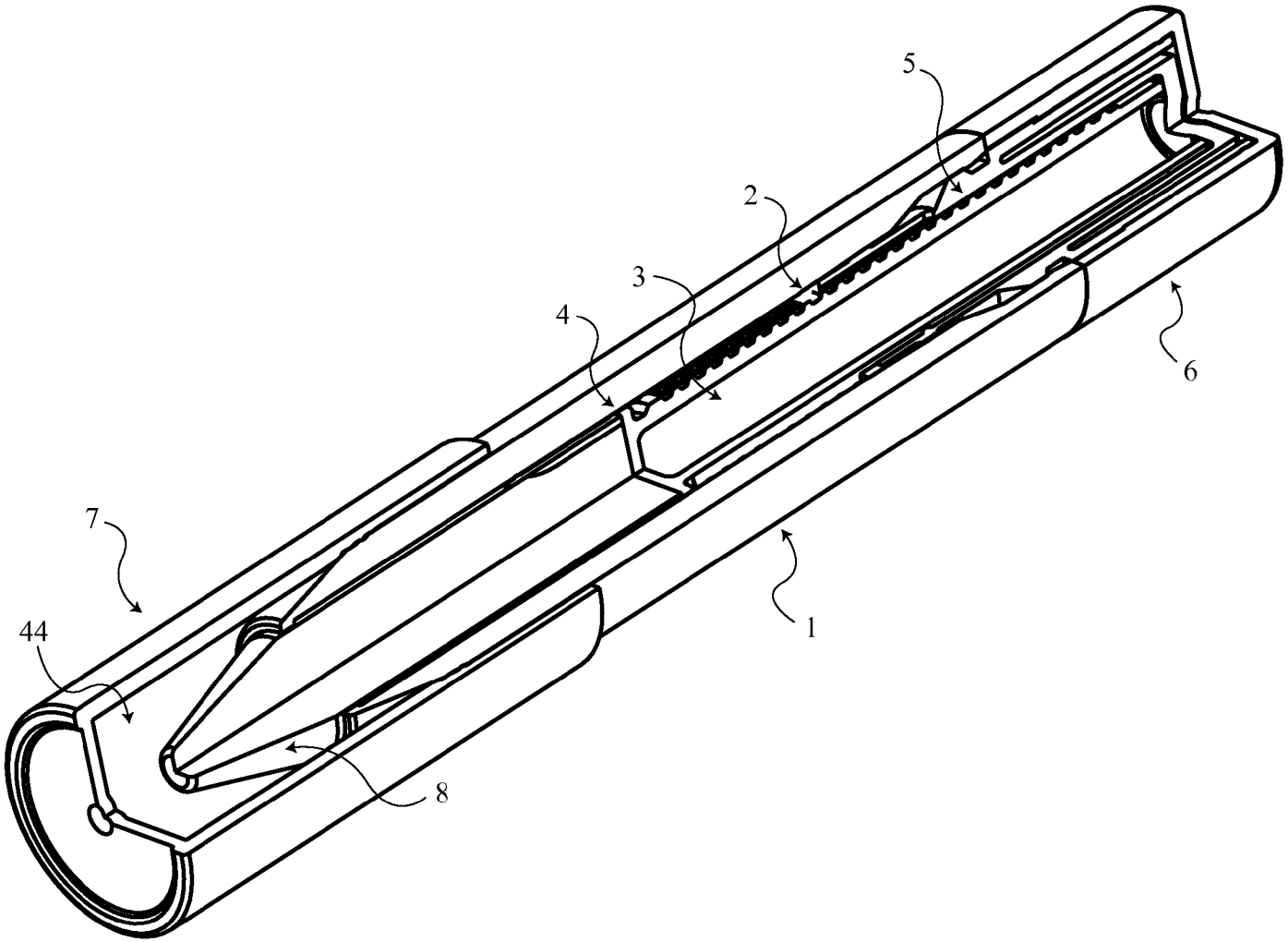
FIG. 2 is perspective view of the present invention, showing the half section taken along the plane 2-2.
Figure 3:
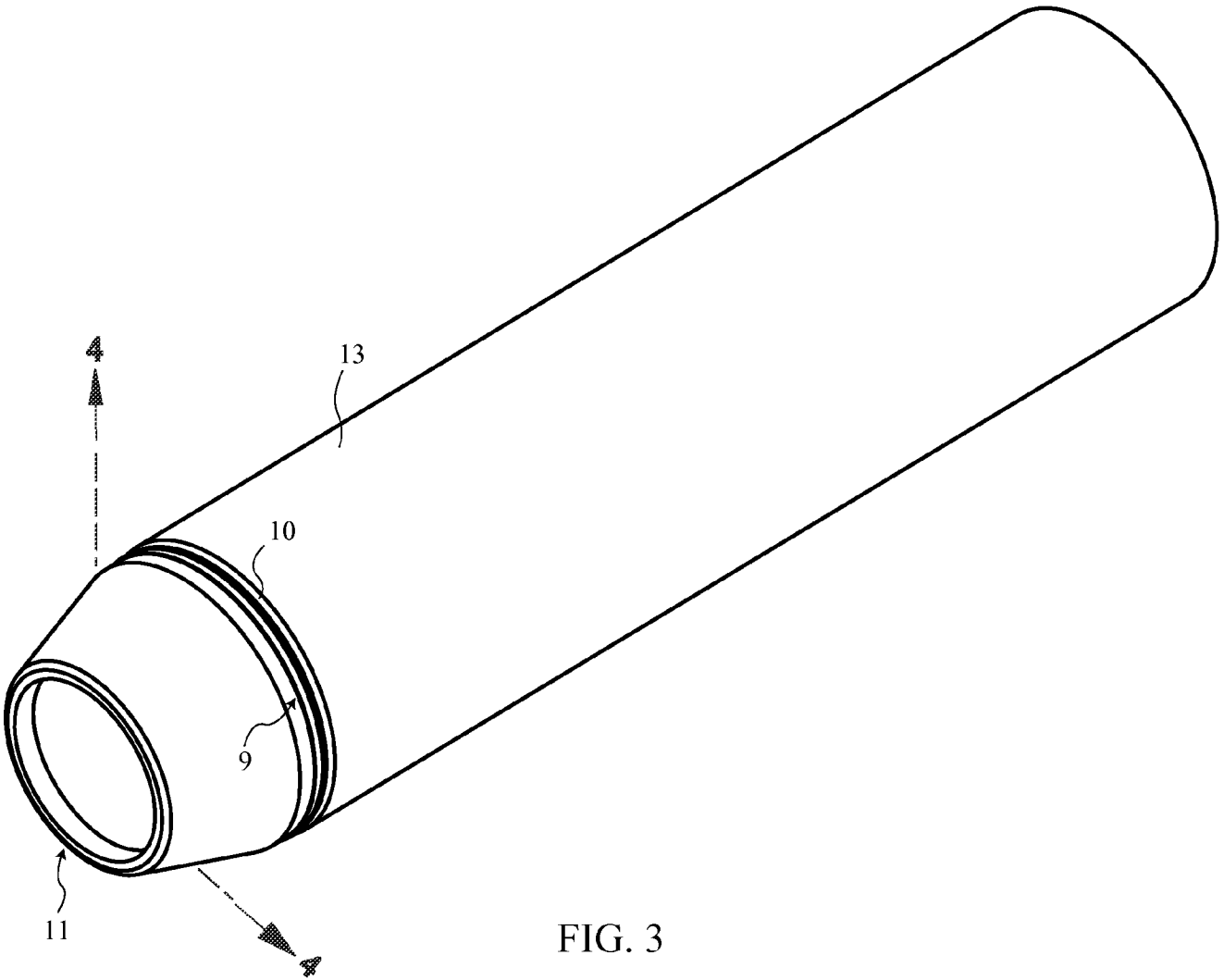
FIG. 3 is a perspective view of the barrel, showing the plane 4-4 which a half section is taken.
Figure 4:
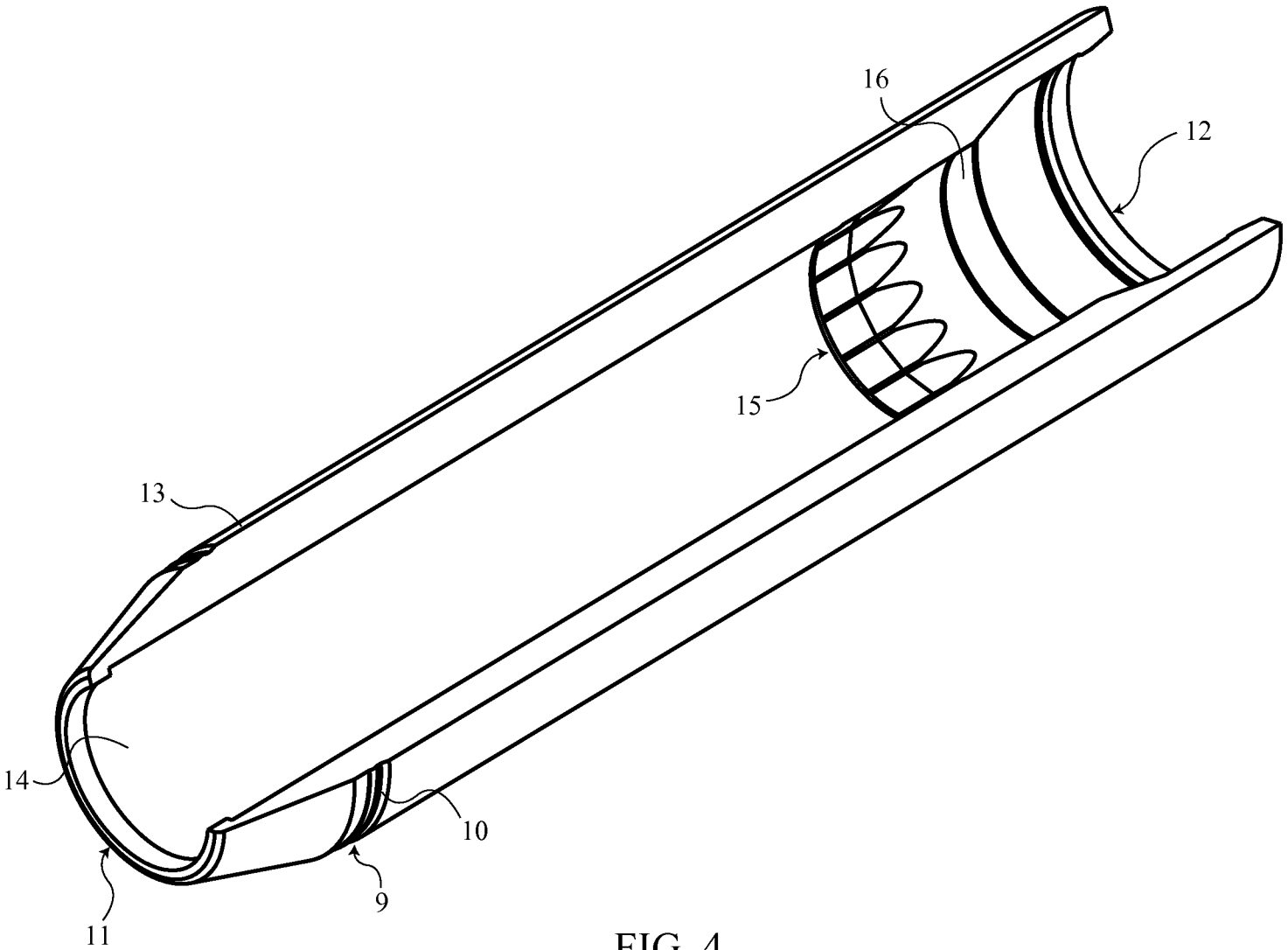
FIG. 4 is a perspective view of the barrel, showing the half section taken along the plane 4-4.
Figure 5:
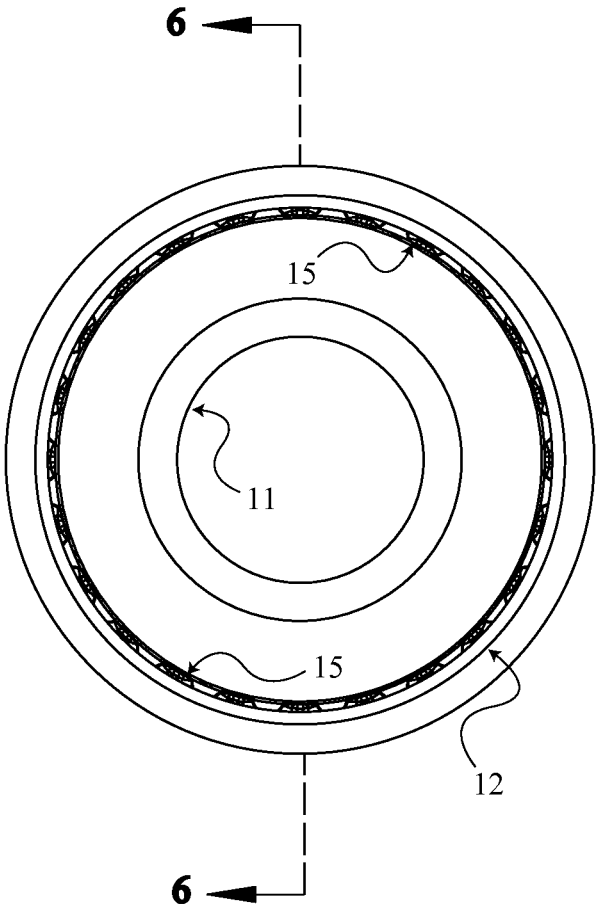
FIG. 5 is a rear view of the barrel, showing the plane 6-6 which a full section is taken.
Figure 6:
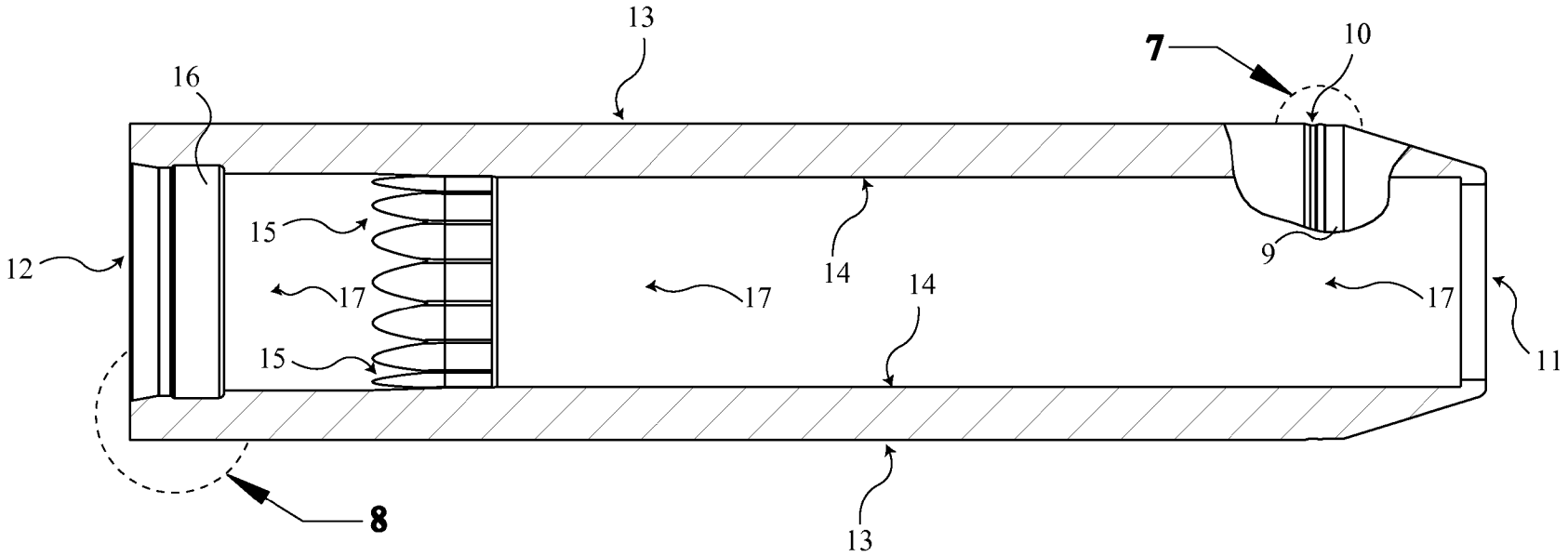
FIG. 6 is a side view of the barrel, showing the full section taken along the plane 6-6, wherein a portion of the first recessed groove and the retention ring remain.
Figure 7:
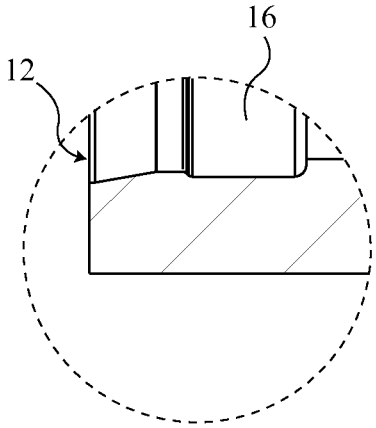
FIG. 7 is a detailed section view taken in FIG. 6.
Figure 8:
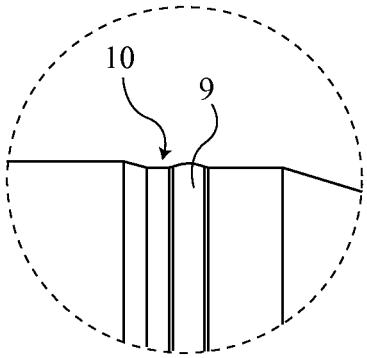
FIG. 8 is another detailed section view taken in FIG. 6.

The present invention is an airtight device for packaging and applying a solid product, as is shown by FIG. 1-FIG. 28. Furthermore, the present invention comprises a barrel 1, a clutch washer 2, a driver 3, a cup 4, an actuator 5, an actuator sleeve 6, a cap 7 and a molded product 8. It is assumed that the molded product 8 is a molded stick, crayon, pomade or cosmetic mass, typically related to cosmetics. Through a mechanical arrangement of these components, shown in FIG. 1-FIG. 3, the molded product 8 should be able to be transversely dispensed out from an airtight enclosure and then into the outside environment. The airtight enclosure is formed through multiple seals between the cap 7 and the barrel 1 as well as the cup 4 and the barrel 1. Having the molded product 8 hermetically enclosed while it is not being used or applied protects it from contamination with the atmosphere. Such contamination could initiate rapid displacement or evaporation of the molded product 8. Such displacement or evaporation is undesirable because this could cause detriment in the performance characteristics of device and the molded product 8.

Generally, the mechanical operations are hereinafter described. The actuator sleeve 6 is attached to the actuator 5. The cup 4 is connected to the driver 3. The molded product 8 is affixed within the cup 4. The driver 3 is keyed into the clutch washer 2. The clutch washer 2 is keyed within the barrel 1. The actuator 5 engages the driver 3. As the actuator sleeve 6 is rotated, the actuator 5 should also rotate. The engagement between the actuator 5 and the driver 3 propels the driver 3 through the clutch washer 2 and the barrel 1, which occurs as the actuator sleeve 6 is rotated. Therefore the cup 4 is also propelled through the barrel 1 transversely, without rotating. Ultimately, the molded product 8 exits the barrel 1 due to the rotation of the actuator sleeve 6.

The barrel 1 provides housing to the mechanical operations and components. As is shown by FIG. 3-FIG. 8, the barrel 1 comprises a retention ring 9, a first recessed locking groove 10, an exit orifice 11, an outer shell surface 13, an inner shell surface 14, a plurality of inner recessed locking groove 15, an inner recessed actuator groove 16 and an inner passage 17. The barrel 1 is a hollow tubular structure. Both the retention ring 9 and the first recessed locking groove 10 allow the cap 7 to be attached onto the barrel 1. The retention ring 9 is positioned adjacently to the first recessed locking groove 10, wherein the retention ring 9 is positioned adjacently to the exit orifice 11. The retention ring 9 and the first recessed locking groove 10 are also both circumferentially positioned on the outer shell surface 13. The exit orifice 11 is essentially an opening that the molded product 8 will traverse through when it is dispensed. The inner passage 17 is delineated by the entry orifice 12, the exit orifice 11 and the inner shell surface 14. The inner passage 17 should generally follow a horizontal or linear path. The clutch washer 2 is keyed into the barrel 1 through the plurality of inner recessed locking groove 15. The plurality of inner recessed locking groove 15 is circumferentially positioned within barrel 1 along the inner shell surface 14. The actuator 5 is fitted into the barrel 1 through the inner recessed actuator groove 16, which is positioned circumferentially within the barrel 1 along the inner shell surface 14 and adjacent to the entry orifice 12.

Figure 9:
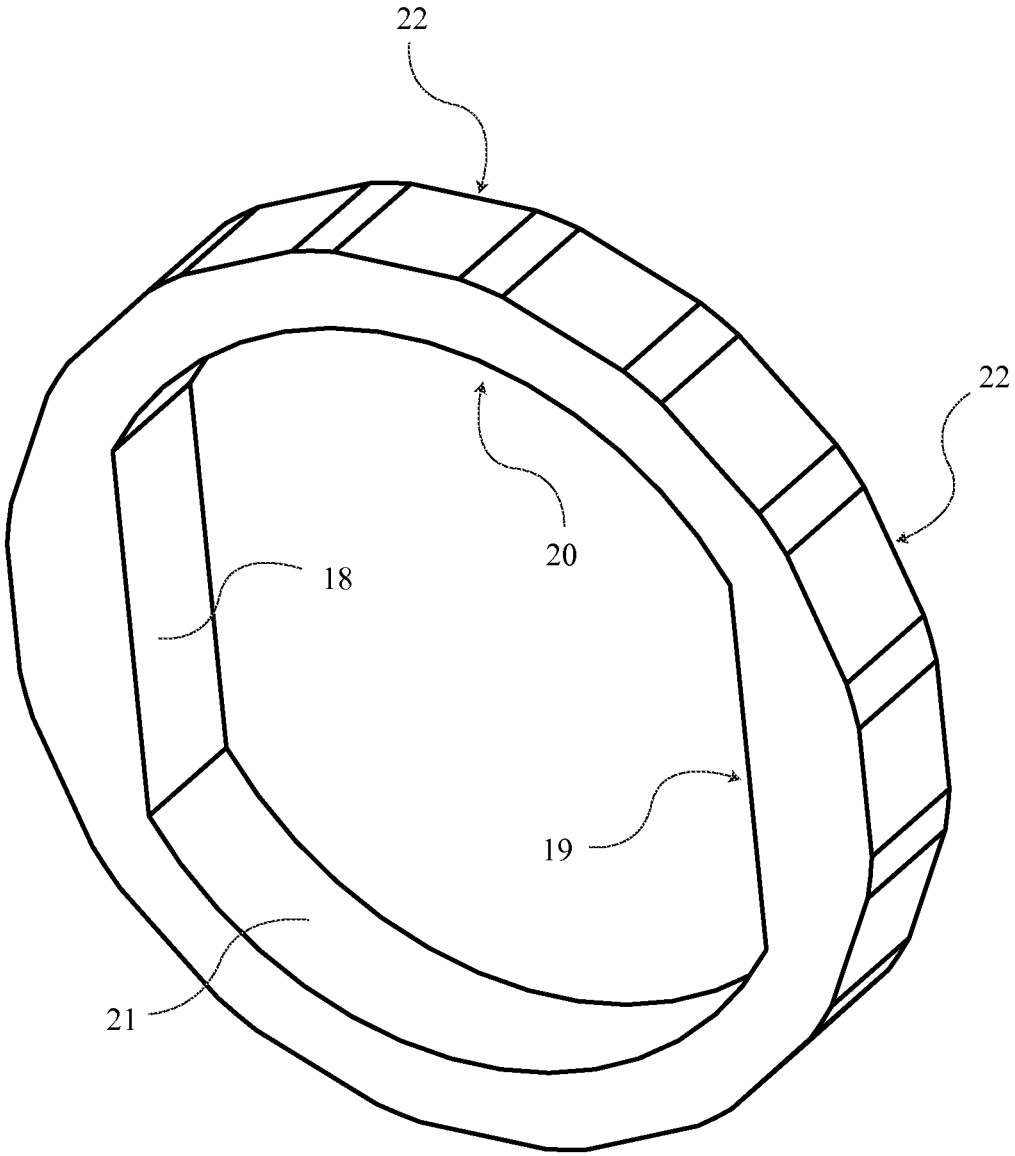
FIG. 9 is a perspective view of the clutch washer.
Figure 10:
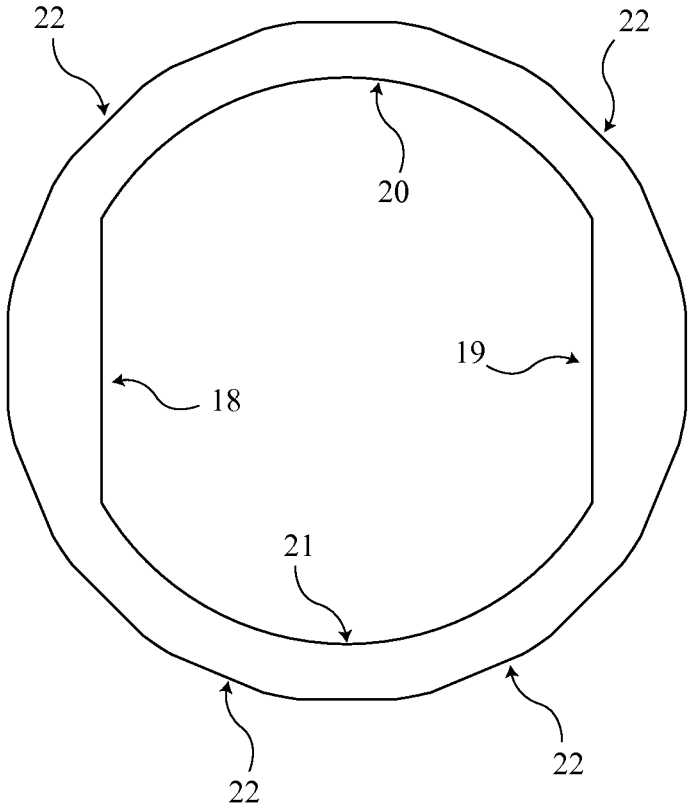
FIG. 10 is a front view of the clutch washer.
Figure 11:
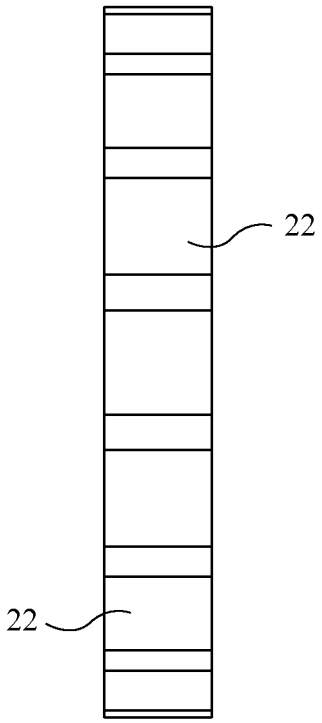
FIG. 11 is a side view of the clutch washer.
Figure 12:
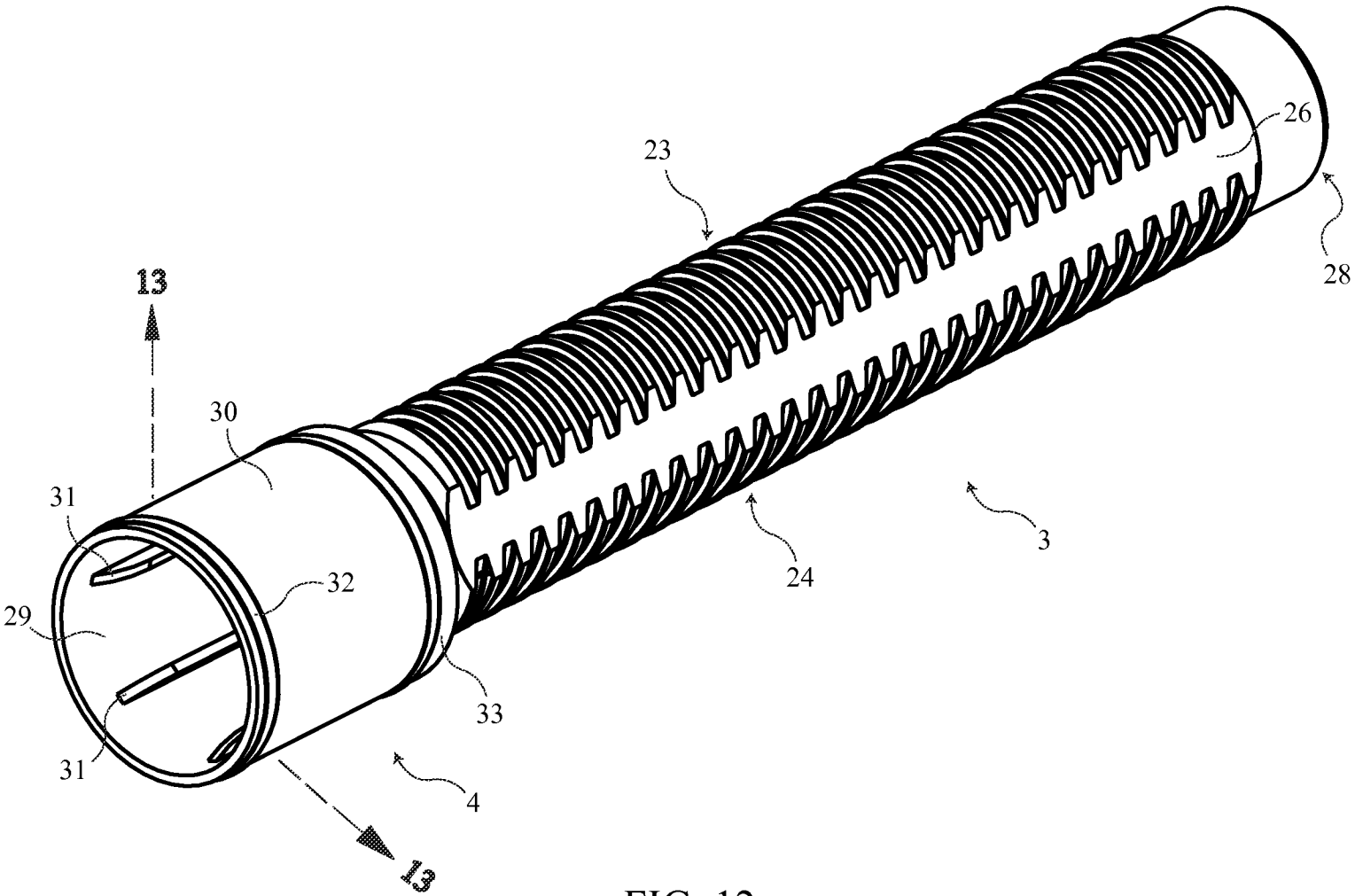
FIG. 12 is a perspective view of the driver and cup, showing the plane 13-13 which a half section is taken.
Figure 13:
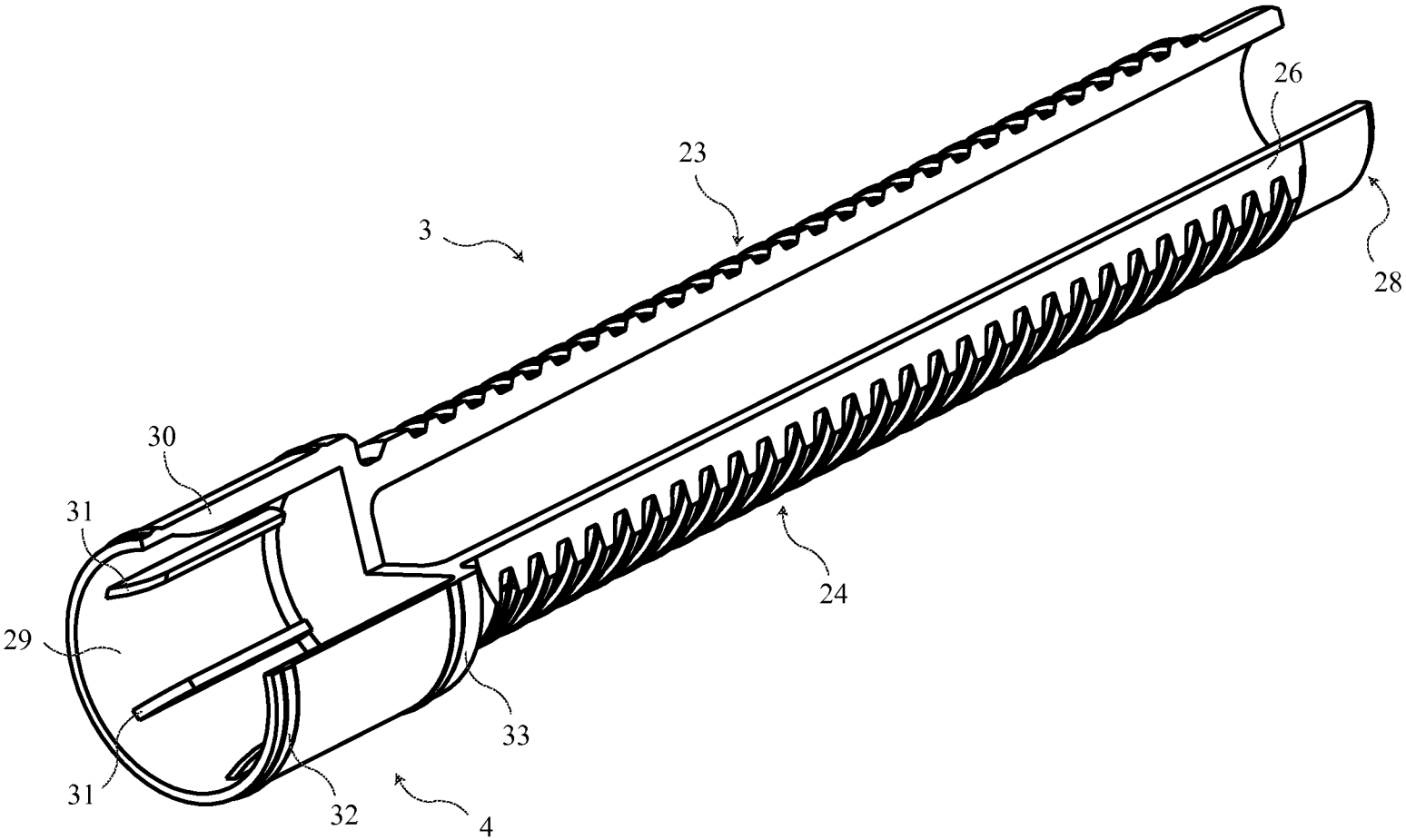
FIG. 13 is a perspective view of the driver and cup, showing the half section taken along the plane 13-13.
Figure 14:
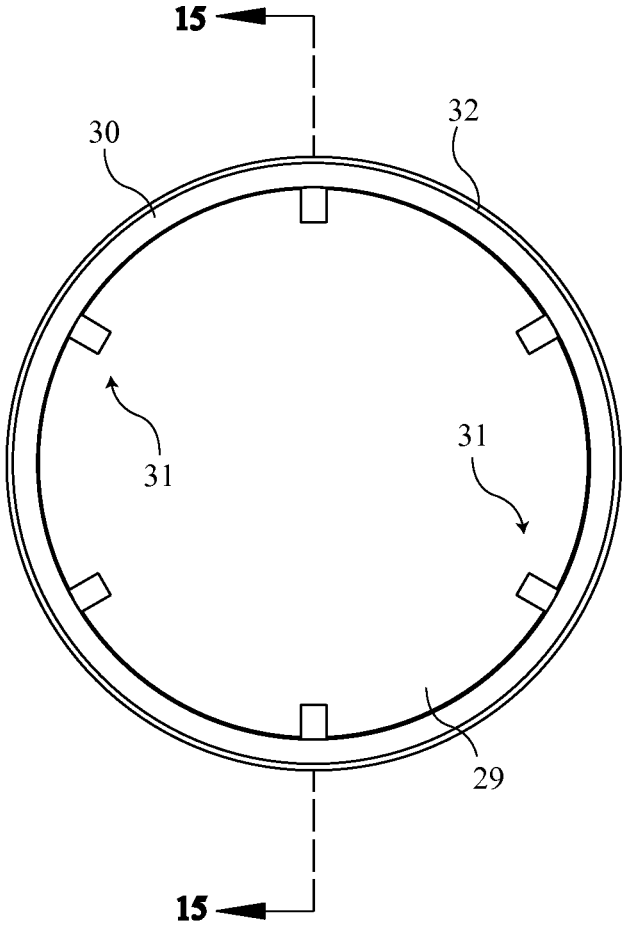
FIG. 14 is a front view of the driver and cup, showing the plane 15-15 which a full section is taken.
Figure 15:
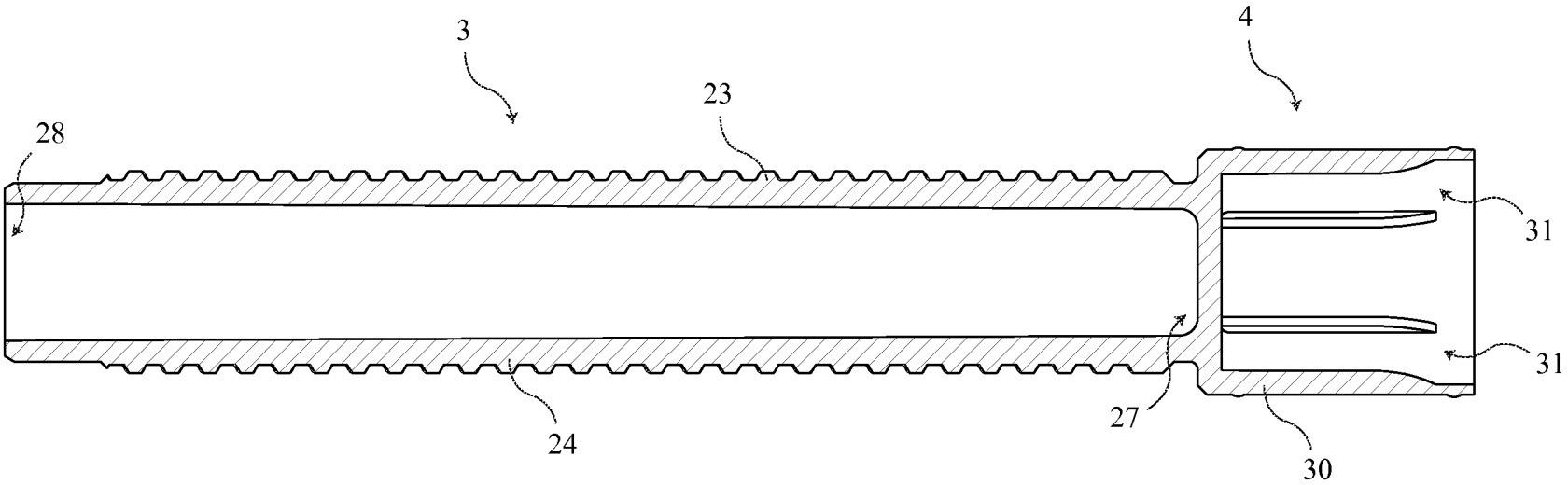
FIG. 15 is a side view of the driver and cup, showing the section taken along the plane 15-15.
Figure 16:
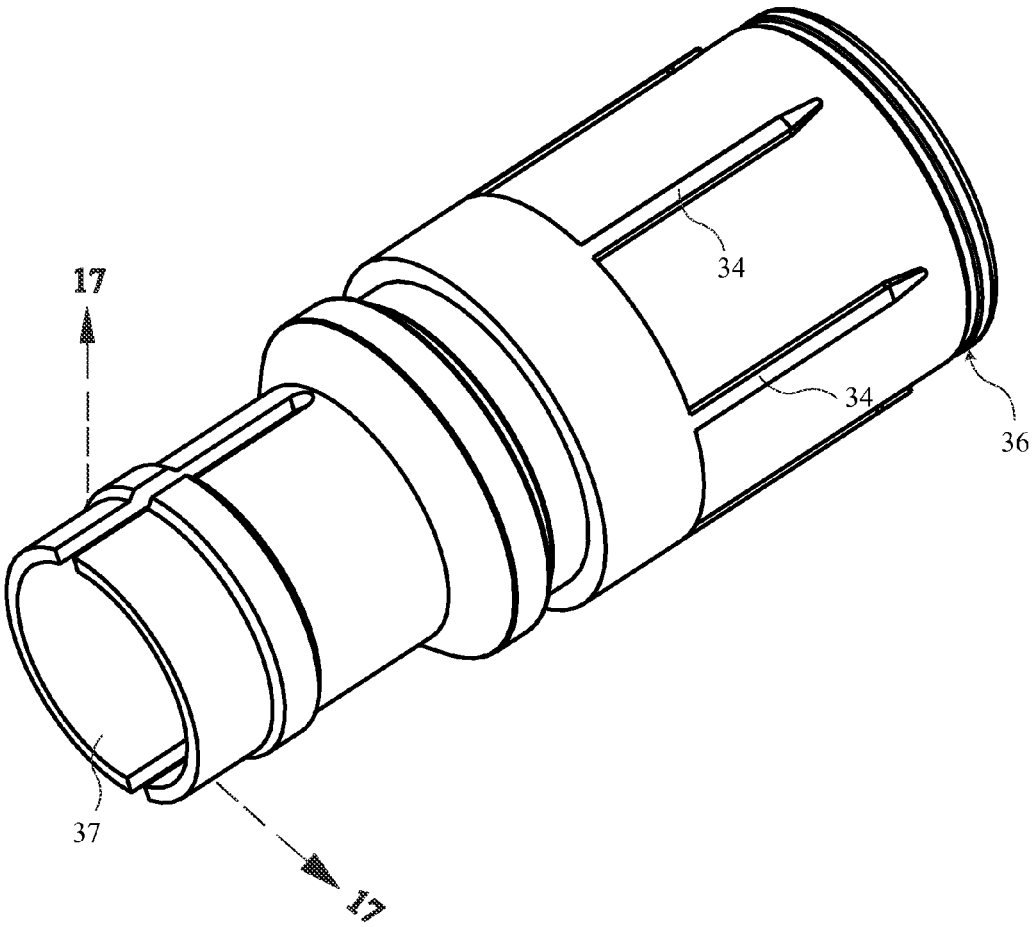
FIG. 16 is a perspective view of the actuator, showing the plane 17-17 which a half section is taken.
Figure 17:
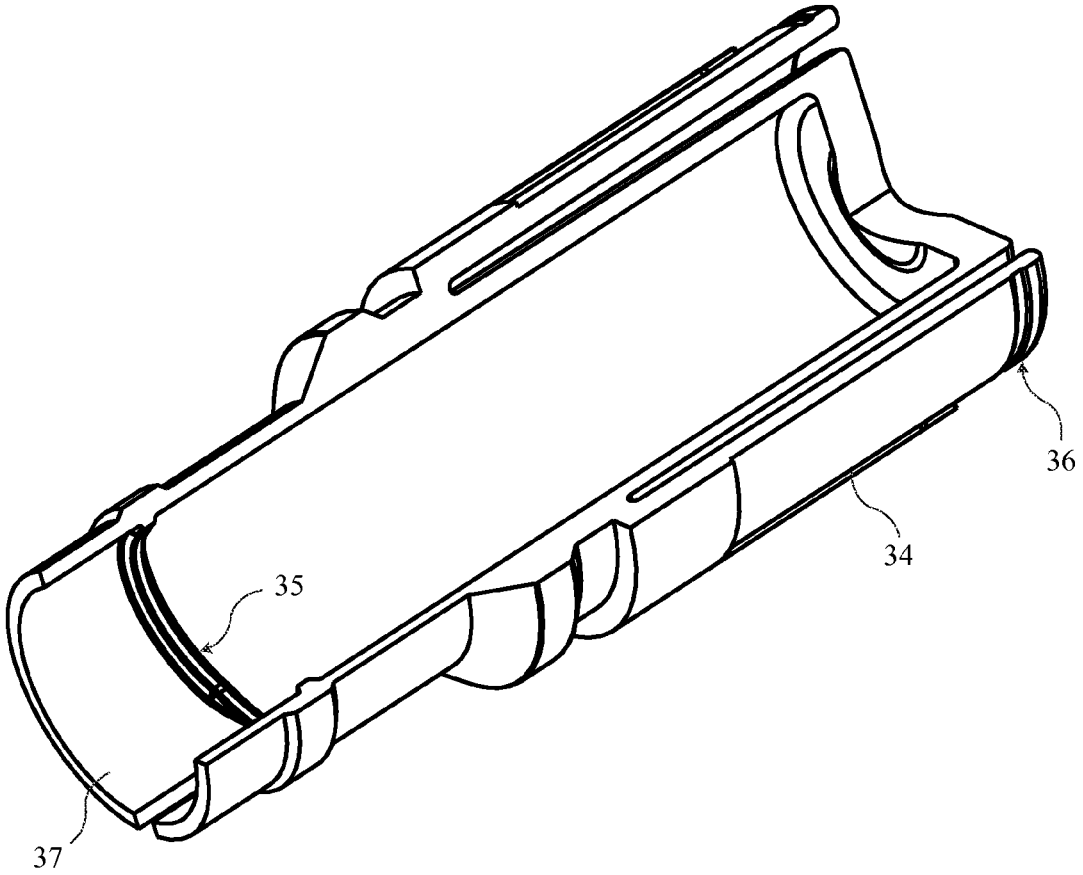
FIG. 17 is a perspective view of the actuator, showing the half section taken along the plane 17-17.
Figure 18:
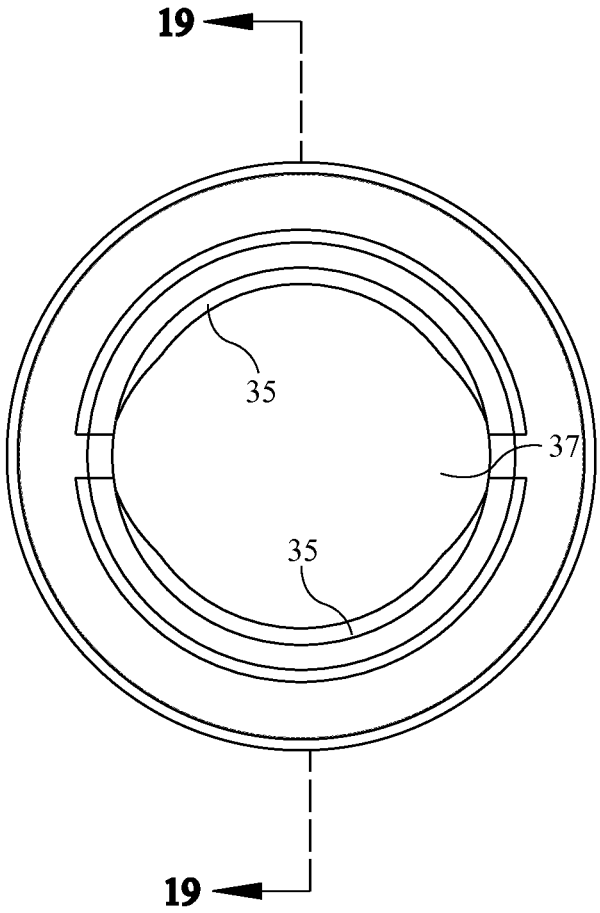
FIG. 18 is a front view of the actuator, showing the plane 19-19 which a full section is taken.
Figure 19:
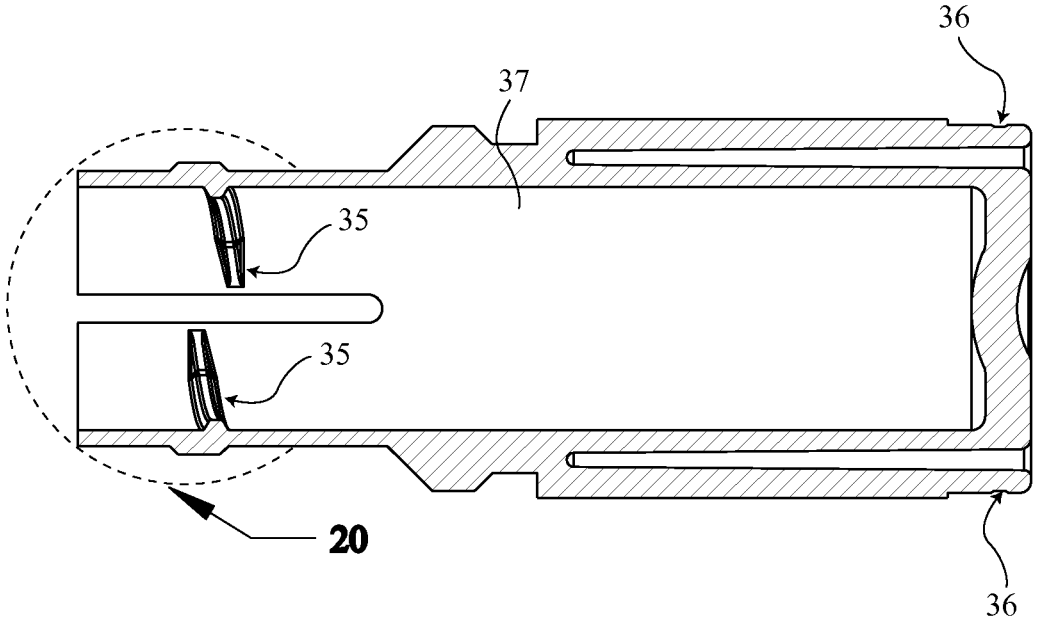
FIG. 19 is a side view of the actuator, showing the full section taken along plane 19-19.
Figure 20:
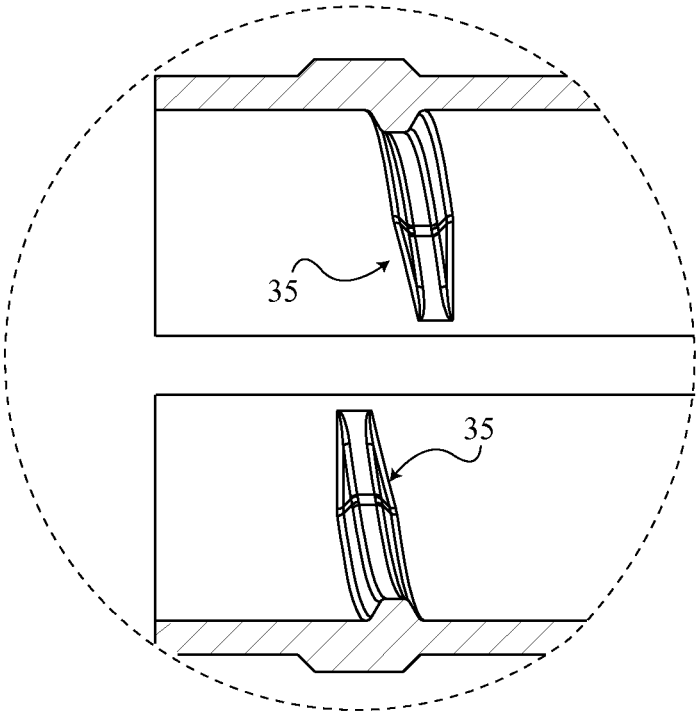
FIG. 20 is a detailed section view taken in FIG. 19
Figure 21:
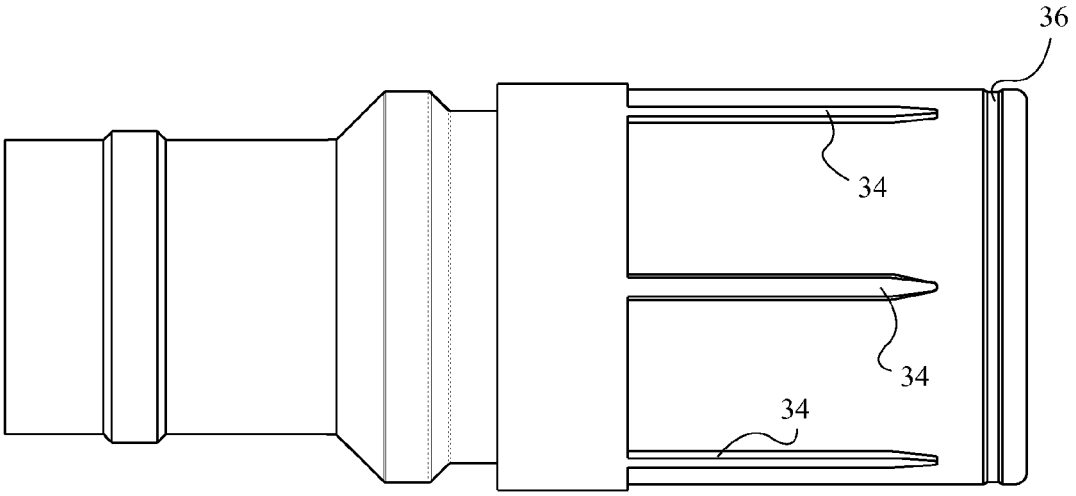
FIG. 21 is a side view of the actuator.

The clutch washer 2, as shown in FIG. 9-FIG. 11, comprises a left inner flat edge 18, a right inner flat edge 19, a first inner round edge 20, a second inner round edge 21 and a plurality of outer flat surfaces 22. Specifically, the clutch washer 2 is used to prevent the rotation of the driver 3. An opening within the clutch washer 2 is delineated by the left inner flat edge 18, the right inner flat edge 19, the first round edge and the second round edge. The left inner flat edge 18 and the right inner flat edge 19 are both positioned between the first inner round edge 20 and the second inner round edge 21; however, the left inner flat edge 18 is positioned oppositely to the right inner flat edge 19. Essentially, the left inner flat edge 18 and the right inner flat edge 19 should guide the driver 3 through clutch washer 2 while restricting the driver 3 from rotation within the opening of the clutch washer 2. Each of the plurality of outer flat surfaces 22 is equidistantly positioned. The clutch washer 2 is keyed within the barrel 1 through the outer flat surfaces 22 and the plurality of inner recessed locking groove 15 of the barrel 1. An apex is formed between each of the outer flat surfaces 22 which are affixed within each of the inner recessed locking groove 15. A contact pressure point is developed between the apex and the inner shell surface 14, keeping the clutch washer 2 lodged in place. Therefore, the clutch washer 2 becomes keyed within the barrel 1 due to the outer flat surfaces 22 and the inner recessed locking grooves 15.

The driver 3, as shown in FIG. 12-FIG. 15, comprises a first threaded surface 23, a second threaded surface 24, a left flat surface 25, a first end 27 and a second end 28. The embodiment of the driver 3 resembles a threaded bolt or "All Thread." The driver 3 should be housed within the barrel 1. The first end 27 is positioned oppositely to the second end 28, in which the first end 27 should be nearest the exit orifice 11 and the second end 28 should be nearest the entry orifice 12. The outer surface of the driver 3 is partially threaded, in which the left flat surface 25 and the right flat surface 26 are oppositely positioned between the first threaded surface 23 and the second threaded surface 24. The clutch washer 2 is traversed by the driver 3. In order for the driver 3 to be fitted into the clutch washer 2 so that it cannot rotate, the left flat surface 25 and the right flat surface 26 must interact with the left inner flat edge 18 and the right inner flat edge 19 of the clutch washer 2, respectively. As the driver 3 is propelled forward, it traverses through the clutch washer 2. The first threaded surface 23 should be embodied by the first inner round edge 20 and the seconded threaded surface should be embodied by the second inner round edge 21. However, the first threaded surface 23 and the second threaded surface 24 should not be obstructed in any fashion by the clutch washer 2 so that the driver 3 can smoothly traverse through the clutch washer 2.

The cup 4, as shown in FIG. 12-FIG. 15, comprises a cup cavity 29, a lateral wall 30, a primary cup sealing ring 32, a secondary cup sealing ring 33 and a plurality of longitudinal grips 31. The cup 4 is connected to the first end 27 of the driver 3, oppositely from the cup cavity 29. The function of the cup 4 is to securely grip the molded product 8 and to form a hermetic seal between the lateral wall 30 and the barrel 1. Each of the longitudinal grips 31 is circumferentially positioned within the cup cavity 29. The longitudinal grips 31 can either pierce into the molded product 8 or partially compress the portion of the molded product 8 they are in contact with. Once the molded product 8 is lodged within the cup 4, a vacuum should be created between the molded product 8 and the cup cavity 29. This vacuum further prevents the molded product 8 from being dislodged and should allow the molded product 8 to resist any axial movement. Positioned around the lateral wall 30 are both the primary cup sealing ring 32 and the secondary cup sealing ring 33. The primary cup sealing ring 32 is positioned adjacently to the cup cavity 29 and the secondary cup sealing ring 33 is positioned adjacent to the driver 3. A hermetic seal is created and maintained between the primary cup sealing ring 32, the secondary cup sealing ring 33 and the inner shell surface 14 of the barrel 1. This is due an interference fit with the primary cup sealing ring 32 and the inner shell surface 14 and another interference fit with the secondary cup sealing ring 33 and the inner shell surface 14. As the driver 3 is propelled forward through the barrel 1, the cup 4 also is propelled forward. Since the cup 4 only forms an interference fit within the barrel 1, the cup 4 is able to move through the barrel 1. The hermetic seal with the primary cup sealing ring 32 and the secondary cup sealing ring 33 keeps the molded product 8 sequestered from the innards of the barrel 1.

The actuator 5, as shown in FIG. 16-FIG. 21, comprises a plurality of outer longitudinal protrusions 34, a plurality of mechanical actuating splines 35, a second recessed locking groove 36 and an actuator cavity 37. The function of the actuator 5 is to engage the driver 3 and to induce motion in the driver 3 so that it can be propelled through the clutch washer 2. In the preferred embodiment of the mechanical actuating splines 35, these are semicircular protrusions within the actuator cavity 37. The driver 3 should be partially inserted within the actuator cavity 37. Each of the mechanical actuating teeth should be inserted between various threads of the first threaded surface 23 and the second threaded surface 24 of the driver 3. The rotation of the actuator 5 should, in effect, propel the driver 3 forward through the clutch washer 2. Since the threads on the driver 3 are assumed to be helical, the force from the mechanical actuating splines 35 attempts to rotate the driver 3. The driver 3 cannot rotate because of the clutch washer 2, so the force from the mechanical actuating splines 35 propels the driver 3 linearly through the clutch washer 2. If the rotation of the actuator 5 is reversed, the driver 3 would be retracted further within the barrel 1. The plurality of outer longitudinal protrusions 34 and the second recessed locking groove 36 are circumferentially positioned around the actuator 5. These features are used to lock the actuator sleeve 6 onto the actuator 5. The entry orifice 12 of the barrel 1 is plugged by the actuator 5. This is performed by fitting the actuator 5 within the inner shell surface 14 of the barrel 1, having a portion of the actuator 5 lodged into the inner recessed actuator groove 16. Preferably, the actuator 5 should stay affixed within the inner shell surface 14 to prevent the innards of the barrel 1 from dislodging from their respective arrangements.

Figure 22:
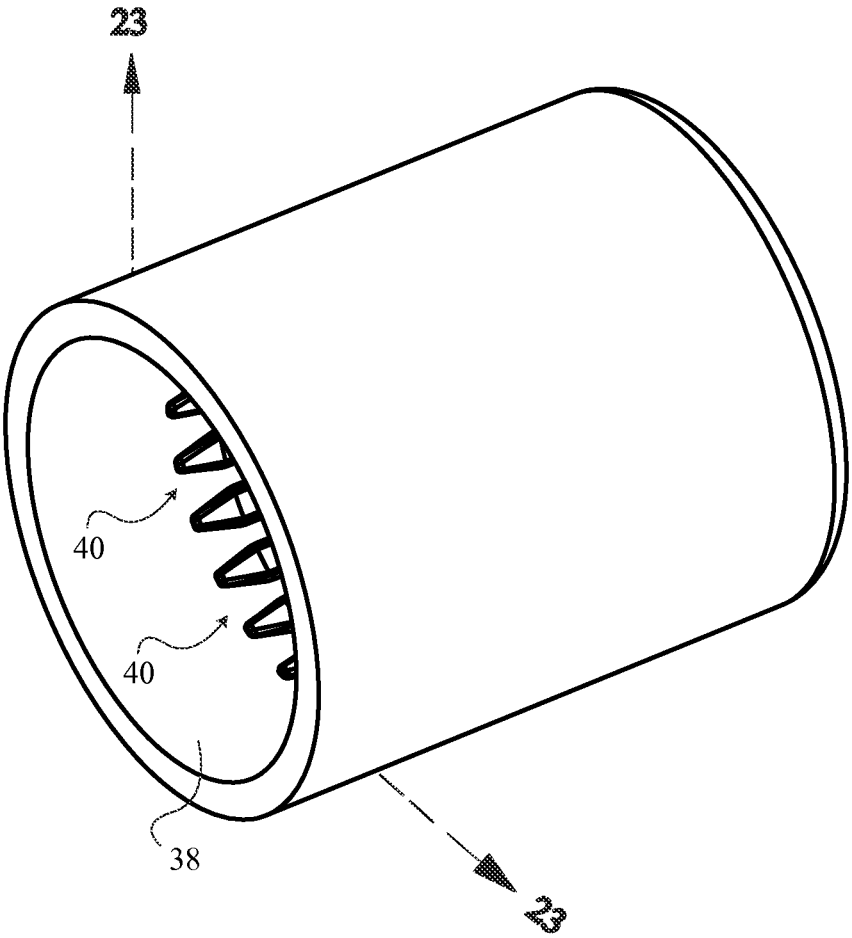
FIG. 22 is a perspective view of the actuator sleeve, showing the plane 23-23 which a half section is taken.
Figure 23:
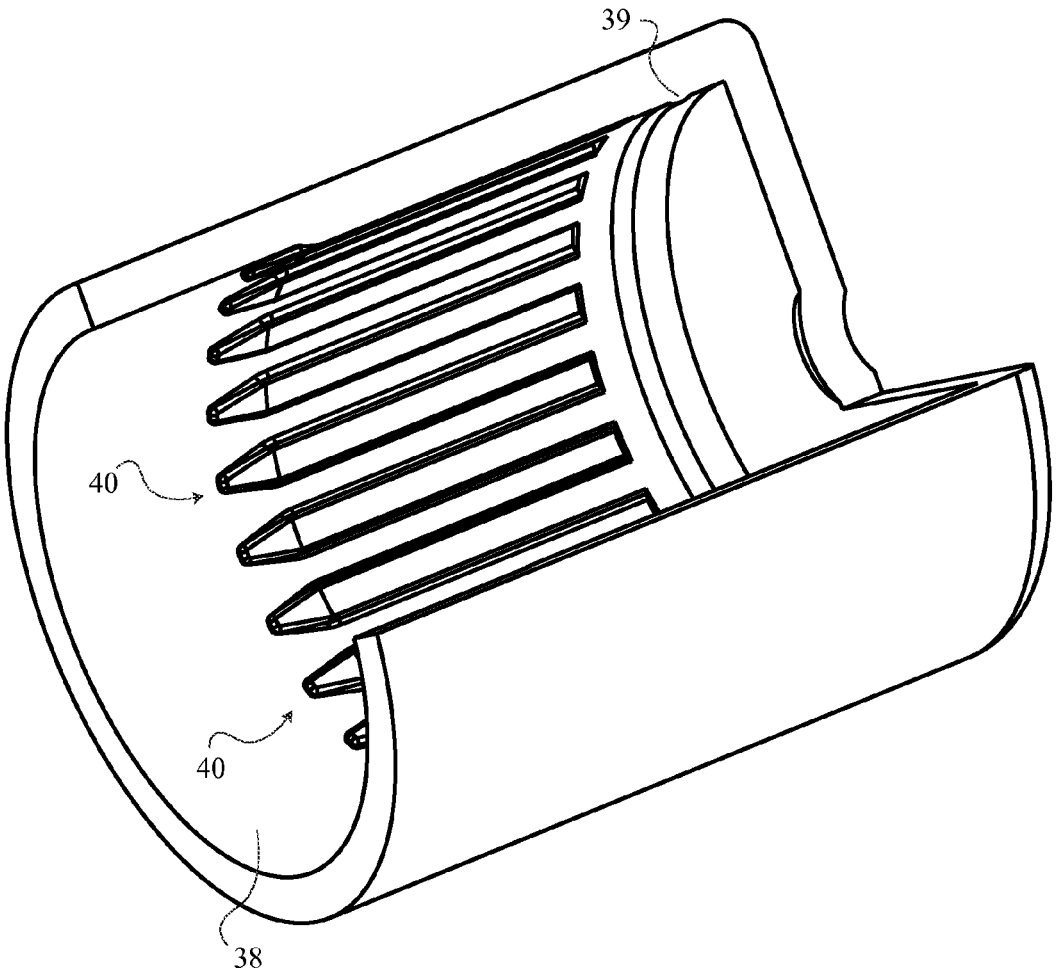
FIG. 23 is a perspective view of the actuator sleeve, showing the half section taken along the plane 23-23.
Figure 24:
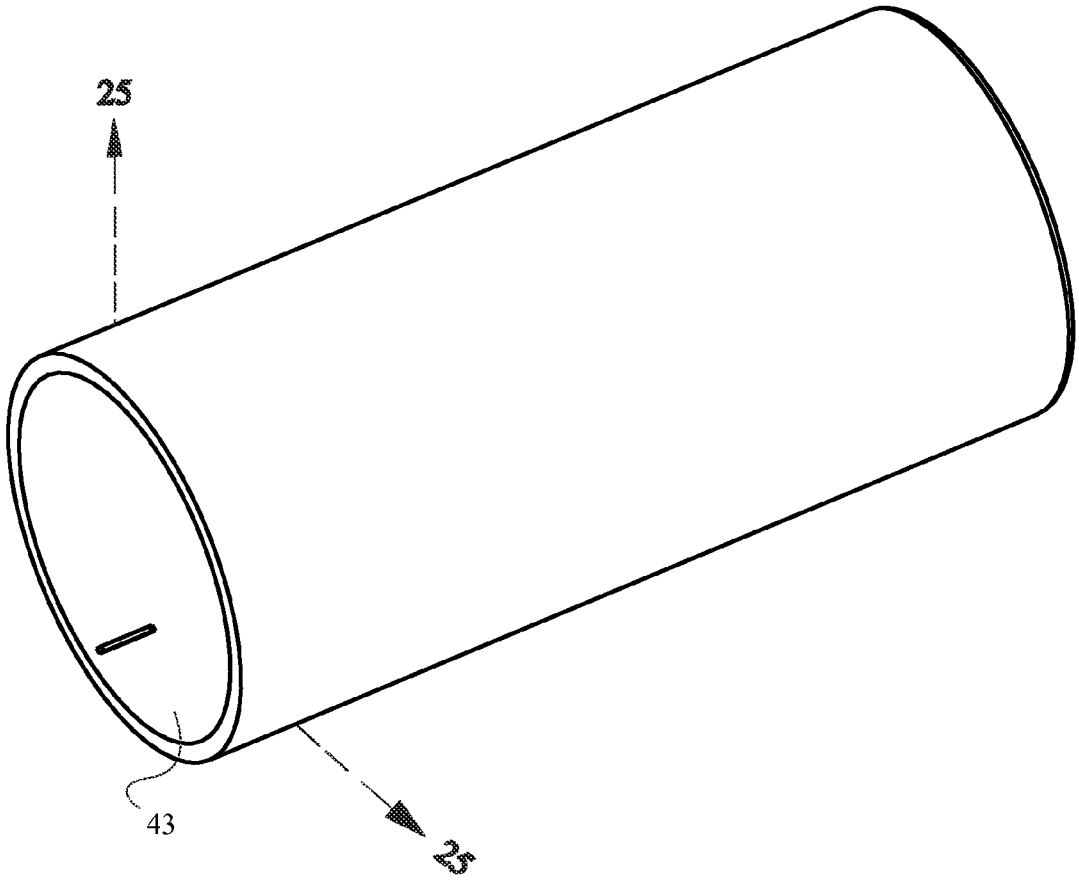
FIG. 24 is a perspective view of the cap, showing the plane 25-25 which a half section is taken.
Figure 25:
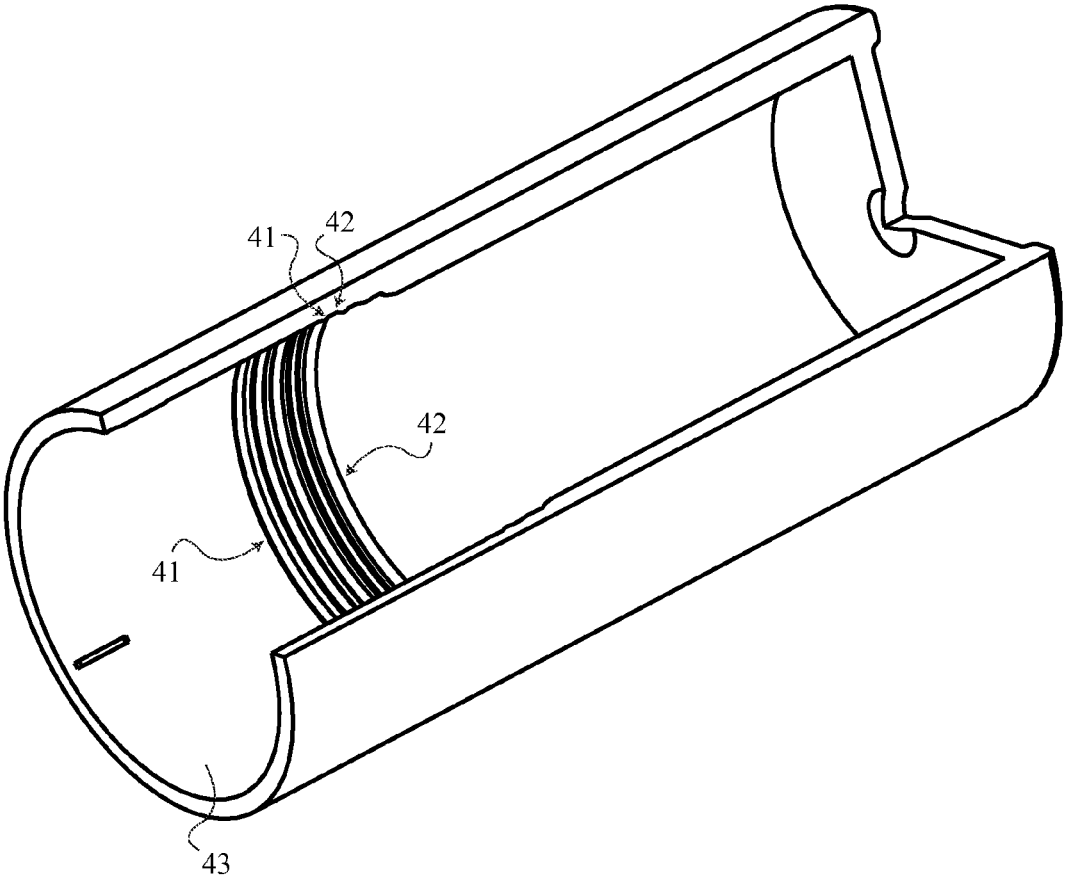
FIG. 25 is a perspective view of the cap, showing the half section taken along the plane 25-25.
Figure 26:
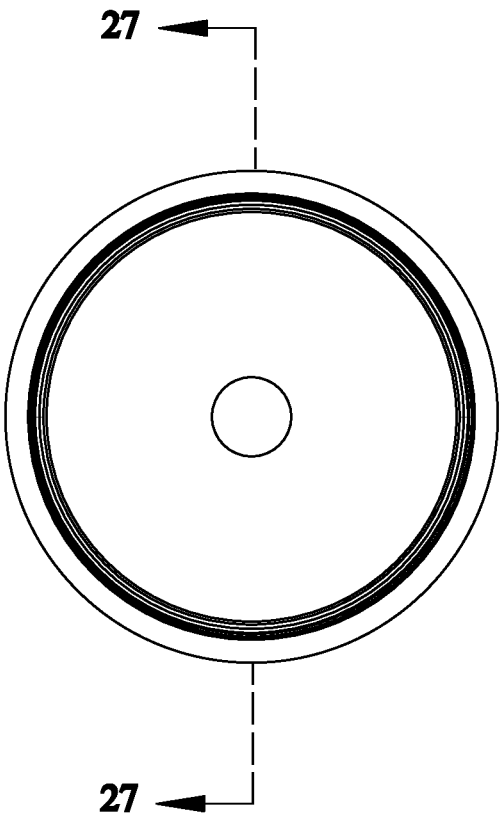
FIG. 26 is a front view of the cap, showing the plane 27-27 which a full section is taken.
Figure 27:
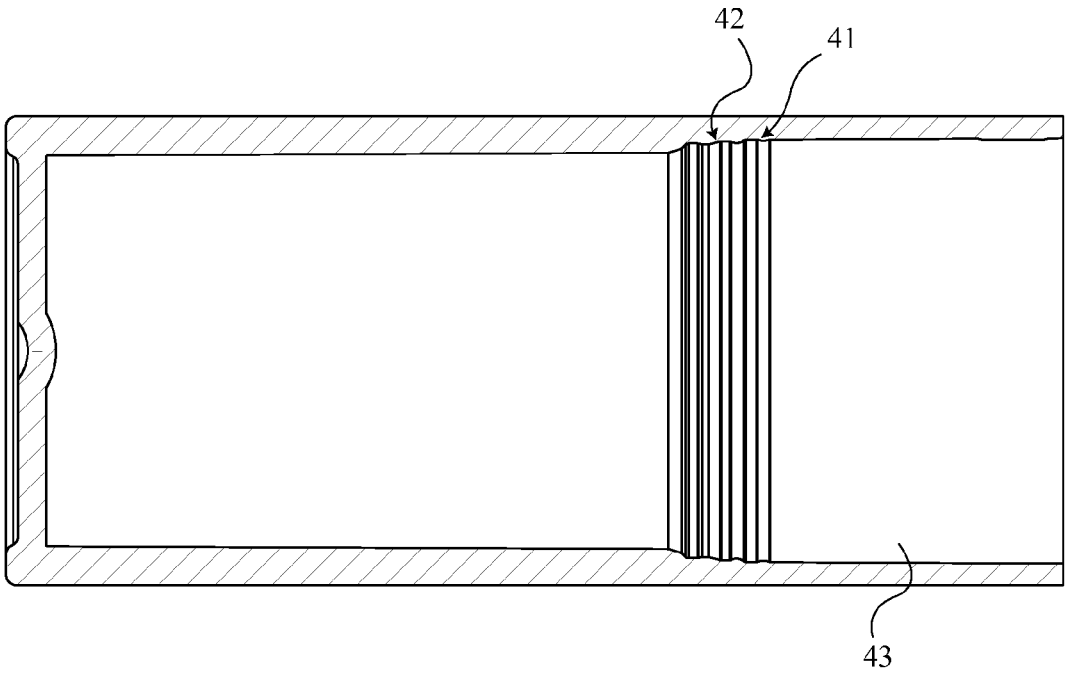
FIG. 27 is a side view of the cap, showing the full section taken along the plane 27-27.
Figure 28:
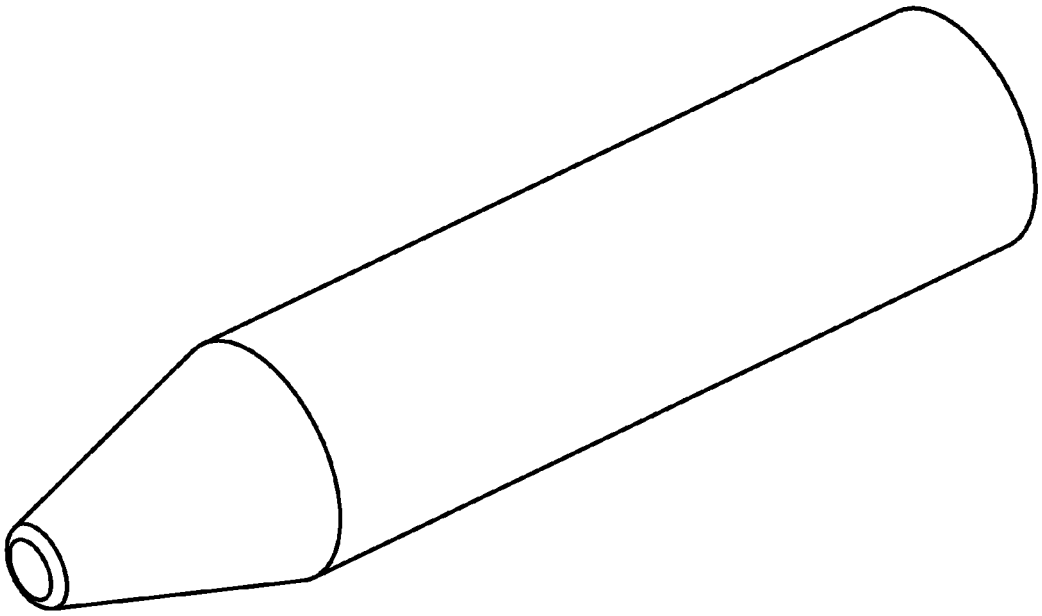
FIG. 28 is a perspective view of the molded product, showing the preferred embodiment.

The actuator sleeve 6, as shown in FIG. 22-FIG. 23, comprises a sleeve cavity 38, a sleeve ring protrusion 39 and a plurality of inner locking protrusions 40. Both the sleeve ring protrusion 39 and the plurality of inner locking protrusions 40 are positioned circumferentially within the sleeve cavity 38. These features keep the actuator sleeve 6 fixed onto the actuator 5. In order to fix the actuator sleeve 6 onto the actuator 5, the sleeve ring protrusion 39 should be fitted within the second recessed locking groove 36. Mechanical retention between the sleeve ring protrusion 39 and the second recessed locking groove 36 holds the actuator sleeve 6 onto the actuator 5. Although the mechanical retention holds the actuator sleeve 6 onto the actuator 5, this may not be enough to force the actuator 5 to rotate if actuator sleeve 6 is also rotated, which is necessary to actuate the driver 3. Each of the outer longitudinal protrusions 34 of the actuator 5 should be fitted between each of the inner locking protrusions 40 of the actuator sleeve 6. Such an interaction should allow the actuator 5 to rotate as the actuator sleeve 6 is rotated. Essentially, the inner locking protrusions 40 become lodged between the outer longitudinal protrusions 34. The radial force from the inner locking protrusions 40 onto the outer longitudinal protrusions 34 induces the actuator's 5 rotation.

The cap 7, shown in FIG. 24-FIG. 27, comprises a primary cap sealing ring 41, a secondary cap sealing ring 42 and a cap cavity 43. Both the primary cap sealing ring 41 and the secondary cap sealing ring 42 are circumferentially positioned within the cap cavity 43. The primary cap sealing ring 41 is positioned adjacently to the opening of the cap 7 cavity 43; the secondary cap sealing ring 42 is positioned adjacently to the primary cap sealing ring 41 but opposite to the opening of the cap cavity 43. The function of the cap 7 is to enclose the exit orifice 11 of the barrel 1, and to also hermetically seal the molded product 8 within the resulting enclosure. This is performed by fitting the retention ring 9 of the barrel 1 between the primary cap sealing ring 41 and the secondary cap sealing ring 42. This interaction both provides mechanical retention between the cap 7 and the barrel 1, keeping the cap 7 secured onto the barrel 1, and also forms a hermetic seal between the cap 7 and the barrel 1.

Maintaining an airtight enclosure between the cap 7 and the barrel 1, as well as between the cup 4 and the inner shell surface 14 of the barrel 1, ensures that the molded product 8 is not being exposed to the atmosphere while the cap 7 is secured onto the barrel 1. This allows the present invention to be packed with the security that the formula to create the molded product 8 is not affected by the surroundings and the atmosphere. Such an airtight enclosure is denoted as a dynamic vapor chamber 44. The dynamic vapor chamber 44 is formed between the volume enclosed due to the primary cup sealing ring 32 and the primary cap sealing ring 41. Even if the cup's 4 within the barrel 1 changes, the dynamic vapor chamber 44 should be maintained if the cap 7 is fitted over the barrel 1.

Although the invention has been explained in relation to its preferred embodiment, it is to be understood that many other possible modifications and variations can be made without departing from the spirit and scope of the invention as hereinafter claimed.

What is claimed is:

1. An airtight device for packaging and applying a solid product comprises, a barrel;

a clutch washer;

a driver;

a cup;

an actuator;

an actuator sleeve;

a cap;

a molded product;

the barrel comprises a retention ring, a first recessed locking groove, an exit orifice, an entry orifice, an outer shell surface, an inner shell surface, a plurality of inner recessed locking grooves, an inner recessed actuator groove and an inner passage;

the clutch washer comprises a left inner flat edge, a right inner flat edge, a first inner round edge, a second inner round edge and a plurality of outer flat surfaces;

the driver comprises a first threaded surface, a second threaded surface, a left flat surface, a right flat surface, a first end and a second end;

the cup comprises a cup cavity, a lateral wall, a plurality of longitudinal grips, a primary cup sealing ring and a secondary cup sealing ring;

the actuator comprises a plurality of outer longitudinal protrusions, a plurality of mechanical actuating splines, a second recessed locking groove and an actuator cavity;

the actuator sleeve comprises a sleeve cavity, a sleeve ring protrusion and a plurality of inner locking protrusions; and the cap comprises a primary cap sealing ring, a secondary cap sealing ring and a cap cavity.

2. The airtight device for packaging and applying a solid product as claimed in claim 1 comprises, the first end being positioned oppositely the second end the cup being connected to the first end opposite to cup cavity;

the plurality of longitudinal grips being circumferentially positioned within the cup cavity;

the primary cup sealing ring being circumferentially positioned on the lateral wall;

the secondary cup sealing ring being circumferentially positioned on the lateral wall;

the primary cup sealing ring being positioned opposite to the secondary cup sealing ring;

the first threaded surface being positioned between the left flat surface and the right flat surface;

the second threaded surface being positioned between the left flat surface and the right flat surface;

the left flat surface being positioned oppositely to the right flat surface; and the first threaded surface being positioned oppositely to the second threaded surface.

3. The airtight device for packaging and applying a solid product as claimed in claim 2 comprises, the lateral wall delineating the cup cavity.

4. The airtight device for packaging and applying a solid product as claimed in claim 1 comprises, the outer shell surface being positioned oppositely to the inner shell surface;

the exit orifice being positioned oppositely to the entry orifice;

the inner passage being delineated by the exit orifice, the inner shell surface and the entry orifice;

the first recessed locking groove being positioned on the outer shell surface;

the retention ring being positioned on the outer shell surface;

the retention ring being positioned adjacently to the first recessed locking groove and the exit orifice;

the inner passage being delineated by the inner shell surface, the entry orifice and the exit orifice.

5. The airtight device for packaging and applying a solid product as claimed in claim 1 comprises, the left inner flat edge being positioned between the first inner round edge and the second inner round edge;

the right inner flat edge being positioned between the first inner round edge and the second inner round edge;

the left inner flat edge being positioned oppositely to the right inner flat edge; and each of the plurality of outer flat surfaces being equidistantly distanced.

6. The airtight device for packaging and applying a solid product as claimed in claim 5 comprises, the plurality of outer flat surface being positioned oppositely to the left inner flat edge, the right inner flat edge, the first inner round edge and the second inner round edge.

7. The airtight device for packaging and applying a solid product as claimed in claim 1 comprises, the plurality of mechanical actuating splines being positioned circumferentially within the actuator cavity;

the second recessed locking groove being positioned oppositely to the actuator cavity; and the second recessed locking groove being positioned adjacently to the plurality of outer longitudinal protrusions.

8. The airtight device for packaging and applying a solid product as claimed in claim 1 comprises, the plurality of inner locking protrusions being positioned circumferentially within the sleeve cavity; and the sleeve ring protrusion being positioned on the sleeve cavity.

9. The airtight device for packaging and applying a solid product as claimed in claim 1 comprises, both the primary cap sealing ring and the secondary cap sealing ring being positioned within the cap cavity; and the primary cap sealing ring being positioned adjacently to the secondary cap sealing ring.

10. The airtight device for packaging and applying a solid product as claimed in claim 1 comprises, the molded product being affixed within the cup cavity by the plurality of longitudinal grips;

the clutch washer being keyed into the barrel through the plurality of inner recessed locking grooves;

the clutch washer being traversed by the driver;

the left inner flat edge being positioned adjacently to the left flat surface;

the right inner flat edge being positioned adjacently to the right flat surface;

the plurality of mechanical actuating splines being engaged with both the first threaded surface and the second threaded surface;

the actuator being secured into the barrel by the inner recessed actuator groove;

the sleeve ring protrusion being affixed within the second recessed locking groove;

each of the plurality of outer longitudinal protrusions being fitted between each of the plurality of inner locking protrusions; and the cap being removably attached to the barrel, wherein the retention ring is fitted between the primary cap sealing ring and the secondary cap sealing ring.

11. The airtight device for packaging and applying a solid product as claimed in claim 10 comprises, the molded product being hermetically enclosed by the cap.

12. The airtight device for packaging and applying a solid product as claimed in claim 1 comprises, a dynamic vapor chamber; and the dynamic vapor chamber being hermetically formed by the primary cup sealing ring, the secondary cup sealing ring and the inner shell surface.

13. An airtight device for packaging and applying a solid product comprises, a barrel;

a clutch washer;

a driver;

a cup;

an actuator;

an actuator sleeve;

a cap;

a molded product;

a dynamic vapor chamber;

the barrel comprises a retention ring, a first recessed locking groove, an exit orifice, an entry orifice, an outer shell surface, an inner shell surface, a plurality of inner recessed locking grooves, an inner recessed actuator groove and an inner passage;

the clutch washer comprises a left inner flat edge, a right inner flat edge, a first inner round edge, a second inner round edge and a plurality of outer flat surfaces;

the driver comprises a first threaded surface, a second threaded surface, a left flat surface, a right flat surface, a first end and a second end;

the cup comprises a cup cavity, a lateral wall, a plurality of longitudinal grips, a primary cup sealing ring and a secondary cup sealing ring;

the actuator comprises a plurality of outer longitudinal protrusions, a plurality of mechanical actuating splines, a second recessed locking groove and an actuator cavity;

the actuator sleeve comprises a sleeve cavity, a sleeve ring protrusion and a plurality of inner locking protrusions;

the cap comprises a primary cap sealing ring, a secondary cap sealing ring and a cap cavity;

both the primary cap sealing ring and the secondary cap sealing ring being positioned within the cap cavity;

the primary cap sealing ring being positioned adjacently to the secondary cap sealing ring; and the dynamic vapor chamber being hermetically formed by the primary cup sealing ring, the secondary cup sealing ring and the inner shell surface.

14. The airtight device for packaging and applying a solid product as claimed in claim 13 comprises, the first end being positioned oppositely the second end the cup being connected to the first end opposite to cup cavity;

the plurality of longitudinal grips being circumferentially positioned within the cup cavity;

the primary cup sealing ring being circumferentially positioned on the lateral wall;

the secondary cup sealing ring being circumferentially positioned on the lateral wall;

the primary cup sealing ring being positioned opposite to the secondary cup sealing ring;

the first threaded surface being positioned between the left flat surface and the right flat surface;

the second threaded surface being positioned between the left flat surface and the right flat surface;

the left flat surface being positioned oppositely to the right flat surface; and the first threaded surface being positioned oppositely to the second threaded surface.

15. The airtight device for packaging and applying a solid product as claimed in claim 14 comprises, the lateral wall delineating the cup cavity.

16. The airtight device for packaging and applying a solid product as claimed in claim 13 comprises, the outer shell surface being positioned oppositely to the inner shell surface;

the exit orifice being positioned oppositely to the entry orifice;

the inner passage being delineated by the exit orifice, the inner shell surface and the entry orifice;

the first recessed locking groove being positioned on the outer shell surface;

the retention ring being positioned on the outer shell surface;

the retention ring being positioned adjacently to the first recessed locking groove and the exit orifice; and the inner passage being delineated by the inner shell surface, the entry orifice and the exit orifice.

17. The airtight device for packaging and applying a solid product as claimed in claim 13 comprises, the left inner flat edge being positioned between the first inner round edge and the second inner round edge;

the right inner flat edge being positioned between the first inner round edge and the second inner round edge;

the left inner flat edge being positioned oppositely to the right inner flat edge;

each of the plurality of outer flat surfaces being equidistantly distanced; and the plurality of outer flat surface being positioned oppositely to the left inner flat edge, the right inner flat edge, the first inner round edge and the second inner round edge.

18. The airtight device for packaging and applying a solid product as claimed in claim 13 comprises, the plurality of mechanical actuating splines being positioned circumferentially within the actuator cavity;

the second recessed locking groove being positioned oppositely to the actuator cavity; and the second recessed locking groove being positioned adjacently to the plurality of outer longitudinal protrusions.

19. The airtight device for packaging and applying a solid product as claimed in claim 13 comprises, the plurality of inner locking protrusions being positioned circumferentially within the sleeve cavity; and the sleeve ring protrusion being positioned on the sleeve cavity.

20. The airtight device for packaging and applying a solid product as claimed in claim 13 comprises, the molded product being affixed within the cup cavity by the plurality of longitudinal grips;

the molded product being hermetically enclosed by the cap;

the clutch washer being keyed into the barrel through the plurality of inner recessed locking grooves;

the clutch washer being traversed by the driver;

the left inner flat edge being positioned adjacently to the left flat surface;

the right inner flat edge being positioned adjacently to the right flat surface;

the plurality of mechanical actuating splines being engaged with both the first threaded surface and the second threaded surface;

the actuator being secured into the barrel by the inner recessed actuator groove;

the sleeve ring protrusion being affixed within the second recessed locking groove;

each of the plurality of outer longitudinal protrusions being fitted between each of the plurality of inner locking protrusions; and the cap being removably attached to the barrel, wherein the retention ring is fitted between the primary cap sealing ring and the secondary cap sealing ring.

* * * * *